United States Patent [19]

Covington

[11] Patent Number: 4,731,089

[45] Date of Patent: Mar. 15, 1988

[54] LEATHER TANNING PROCESS USING ALUMINIUM (III) AND TITANIUM (IV) COMPLEXES

[75] Inventor: Anthony D. Covington, Northampton, England

[73] Assignee: Tioxide Group PLC, London, England

[21] Appl. No.: 788,065

[22] Filed: Oct. 16, 1985

[30] Foreign Application Priority Data

Oct. 24, 1984 [GB] United Kingdom ..... 8426851

[51] Int. Cl.[4] ..... C14C 3/04

[52] U.S. Cl. ..... 8/94.29; 8/24.21; 8/94.27; 8/94.26; 8/94.19 R; 8/94.21

[58] Field of Search ..... 8/24.21, 24.19, 8.57, 8/24.26, 24.29, 24.27; 252/8.57

[56] References Cited

U.S. PATENT DOCUMENTS

| | | | |
|---|---|---|---|
| 1,941,485 | 8/1943 | Pasternack et al. | 8/94.29 |
| 4,312,632 | 1/1982 | Torrini | 8/94.19 |
| 4,354,940 | 10/1982 | Suhac et al. | 252/156 |
| 4,560,384 | 12/1985 | Vanni et al. | 8/94.24 |

FOREIGN PATENT DOCUMENTS 2068999A 2/1980 United Kingdom .

OTHER PUBLICATIONS

6001 Chem. Abstracts 100:53496f.

6001 Chem. Abstracts 100:141162z.

Sykes and Covington—Article "Developments in Aluminum Tannage" also abstracted in CA100:53496f.

*Primary Examiner*—Paul Lieberman

*Assistant Examiner*—John F. McNally

*Attorney, Agent, or Firm*—Fitch, Even, Tabin & Flannery

[57] ABSTRACT

In a leather tanning process, animal skins are treated with a tanning agent comprising an aluminium (III)/-titanium (IV) mixed complex with a salt of a polyhydroxymonocarboxylic acid as a masking compound. The masking compound preferably has the general formula:

$$HOCH_2(CHOH)_n\ CO_2M$$

wherein M is an alkali metal, and n is 2 to 6. Especially preferred masking compounds are sodium gluconate and sodium glucoheptonate. The same process can be used for a wide range of skins, both as a base tannage and in combination with other tanning processes.

14 Claims, No Drawings

LEATHER TANNING PROCESS USING ALUMINIUM (III) AND TITANIUM (IV) COMPLEXES

FIELD OF THE INVENTION

This invention relates to a leather tanning process, particularly suitable for making white leather. The process of the invention is therefore useful in the manufacture of bovine and fellmongered sheepskin leathers to be dyed in pastel shades of improved brightness and for reptile leathers in which the natural markings are required to be retained and not obscured by the base colour of the tannage. The process has particular, but not exclusive, application in the field of white washable sheepskin rug manufacture.

DESCRIPTION OF THE PRIOR ART

It is a required feature of rugskins that the wool staple should be long; using skins typically available for the purpose it is undesirable to clip the wool shorter than the natural length. A white or natural wool colour is preferred.

Current commercial tanning processes fall into two broad categories. Firstly, salts of chromium (III) may be used. The tannage imparts a blue colour to the leather and the product is stable to mild detergent washing even in hot water. Skin is made of collagen which is reactive to chromium (III), but wool consists of keratin fibres which are not penetrated by chromium (III) molecular ions under normal tanning conditions. However, the action of light, water and variable temperature during the life of the animal causes weathering of the wool, observed as splitting and opening-up of the scaly structure at the tips. This exposes the inner structure, permitting the chrome to penetrate and react. Tanning the partially degraded keratin protein results in a blue-green coloration called tipping. The presence of this undesirable effect means that the wool must be dyed to disguise the colour or, if a natural colour is required, the wool tips must be sheared.

The second category of processes utilises colourless tanning agents amongst which are zirconium (IV) salts, aluminium (III) salts, syntans, synthetic multifunctional organic polymers, aldehydes, aldehyde derivatives, all of which can be applied to collagen singly or more commonly in combination. In this way colouring of the wool is minimised, although yellowing may occur with some of the reagents.

The leather is generally white or pale coloured, but has only moderate hydrothermal stability. To be considered washable, a tannage must not be reversed by the repeated action of aqueous mild detergent (at 40° C. for rugskins), the shrinkage temperature must be high enough for the leather to withstand the washing temperature and there should preferably be a reserve of hydrothermal stability to retain leather integrity through several wash-dry cycles. These criteria are not easily met by currently available tanning techniques.

The use of aluminium (III) salts in the preservation of hides or skins is well known. Collagen can be tawed by the application of aluminium sulphate or alum, together with flour, salt and fatliquor, traditionally egg yolk. The product is white, full, soft leathery. However, the aluminium (III) is not fixed to the collagen and is easily removed by water from the product, which reverts to horny, translucent hide or skin. Reactive aluminium salts, which are much less easily rinsed out of leather, can be used as tanning agents. However, their presence in leather is commonly manifested in the thin product as empty and boardy handle.

The use of titanium (IV) salts in leather tanning is less well known; optimum tanning conditions require high levels of auxiliaries and the resulting plumpness of the leather limits applications. In addition, the tanning actions of both metal salts are hindered by hydrolysis in the large volumes of solution typically required for woolskin tannage to avoid felting the wool during mechanical agitation.

Single bath tannage, using mixed complexes of aluminium (III) and titanium (IV), has been proposed in our British Patent Specification No. 2 068 999.

Masking, the modification of metal molecular ion properties by complexation, is well known in the art, particularly for chrome tanning. Because aluminium and titanium are different to chromium and different to one another in their aqueous chemistries, the preparation of the complexes of this invention must be designed to satisfy the individual requirements of the tanning process. Many masking agents may be used to stabilise a mixed salt of aluminium (III) and titanium (IV) to allow tanning to proceed at pH 3–5. These include polyfunctional carboxylic acid anions such as lactate, tartrate, citrate glutarate, phthalate and their derivatives. The choice of masking agent is determined by two factors. Firstly, the ability to interact with the metal ions, preferably by polydentate interaction, to enhance the solubility at the required pH value of the solution. Secondly, the rate at which the complex is hydrolysed, resulting in metal precipitation and loss of tanning power. The volume of solution as a proportion of the rawstock weight used for tanning depends on the nature of the vessel, the type of rawstock and the type of leather required. Hence, the concentration of mineral offer and therefore the rate of hydrolysis depends upon a combination of circumstances. So, known masking salts are not suitable for all tanning situations.

Surprisingly, it has been found that not only does the combination of aluminium (III) and titanium (IV) retain the desired features of the individual metal tannages, making an adequately tanned, full, soft leather, but, the problems of hydrolysis can also be overcome by masking the metal molecular ions with a polyhydroxymonocarboxyl ligand.

Accordingly, the present invention provides a leather tanning process in which animal skins are treated with a tanning agent comprising a mixed complex of aluminium (III) ions and titanium (IV) ions, and as a masking compound a salt of a polyhydroxymonocarboxylic acid.

Since the tanning agent is essentially a source of aluminium and titanium in solution, suitably masked, alternative methods of preparing the tanning complex can be envisaged. Any suitable source of soluble titanium can be mixed in solution with the appropriate quantity of a soluble aluminium salt, preferably the sulphate. The mixture is then masked in accordance with the invention. For example, titanyl sulphate solution, prepared by the dissolution of hydrous titanium oxide in sulphuric acid, can be mixed with aluminium sulphate in the desired proportions, treated with masking agent and basified to the appropriate acidity.

Alternatively, residual activity in solution after dissolution of hydrous titanium oxide can be used to dissolve hydrated aluminium oxide (often described commercially as bauxite). This serves to reduce the overall free acid content, making later basification more convenient. However, it is not usually possible to introduce the whole of the required aluminium oxide into the mixture in the form of hydrated aluminium oxide. At the acid strengths required to dissolve hydrated titanium oxide, there is considerable risk of solidification of the mass if the $Al_2O_3$:$TiO_2$ ratio exceeds 1.8:1 in the first stage of the process, before dilution can be effected.

The preferred masking compounds for the mixed metal complex have the general formula:

$$HOCH_2(CH.OH)_nCO_2M$$

wherein M is an alkali metal and n is 2 to 6. Sodium gluconate (2,3,4,5,6-pentahydroxy hexanoate) and sodium glucoheptonate (2,3,4,5,6,7-hexahydroxy heptanoate) are especially preferred.

The stability of the complex is dependent on the aluminium to titanium ratio, masking level and concentration in solution. At relatively high concentrations of metals, as in the prepared reagents described in the examples, the masking level can be as low as 0.5 equivalent of carboxylate per mole of metal oxide calculated as $Al_2O_3+TiO_2$. However, with dilute solution (<10 g metal oxide per liter) the masking level should not normally be lower than 1.0 equiv/mole metal oxide and can be, for example, up to 1.5 molar equivalent. Varying both the $Al_2O_3$:$TiO_2$ ratio and the masking level can produce solutions unstable to dilution. Examination of the precipitate indicates that instability is controlled by the titanium (IV) component. Therefore, the main function of the masking agent is to stabilise the titanium (IV). The preferred mixture of metals, particularly for woolskin tannage, is 1.5–2.0:1 molar ratio, 2–3:1 weight ratio $Al_2O_3$:$TiO_2$. At higher ratios, the contribution of the titanium becomes too small. At lower ratios instability in dilute solution increases, significantly increasing the concentration of the complex at which hydrolysis is rapid enough to interfere with the tanning action. For example, the complex containing 1:1 $Al_2O_3$:$TiO_2$ weight ratio, masking level 1.0 equivalent of glucoheptonate per mole $Al_2O_3+TiO_2$, pH 4.0, exhibits rapid hydrolytic instability at 10 g metal oxide per liter. Of course, such concentrations generally do not apply in tannages employing typical industrial solution to rawstock ratios for processing hide or skin without wool or fur.

The pH value to which the tanning complex is basified before use has been shown to have an important effect on the shrinkage temperature of the leather. The explanation may be founded in one or more of the following observations.

(i) Instability to dilution, in terms of the rate of visible onset of hydrolysis, increases with pH.

(ii) Tannages carried out at pH values approaching the final pH (4.2–4.5) after basification, irrespective of the initial pH of the tanning complex solution, are more effective in terms of shrinkage temperature elevation than those carried out at lower pH values.

(iii) The ability of the masked aluminium-titanium system to form the most desirable size of complex for the optimum tanning effect is probably pH-dependent. Evidence for this is deduced from the stabilizing effect, in terms of better stability to hydrolysis, conferred on titanium solutions by the addition of aluminium (III) at $Al_2O_3$:$TiO_2$ mole ratios of 2–4, ie, greater than the ratio preferred for woolskin tannage. This effect is well know and confirms a first order structure of polymeric nature which can be further stabilised by the addition of masking agent.

A typical procedure for solo tanning in accordance with the invention can be summarised as follows:

Pretreat the rawstock for tannage in the normal way;
Adjust rawstock to pH 4–5;
Add tanning complex;
Add fatliquor;
Agitate to promote diffusion of the tanning components into the pelt; and
Drain and complete processing in the normal way.

Woolskins can be prepared for tannage in the normal way with regard to scouring and wool bleaching etc. Initial pH adjustment should be carried out in solution of sufficient ionic strength to avoid swelling the untanned hide or skin. Tanning may be conducted in fresh float, since adverse effects are minimised due to proximity to the isoelectric point where swelling is close to a minimum. The volume of the tanning solution is not critical, except insofar as felting the wool is concerned and it does influence the integrity of the dissolved complex. The complexes used in the process of the invention are sufficiently stable to withstand elevated temperature during woolskin processing; at concentrations typical for analogous chrome tannage, 1–5 g metal oxide per liter at the start of tannage, the bath can be safely warmed to 50° C. without hydrolysing the complex. Fatliquor can be offered at any stage during the tanning process, provided the oils are stable in the presence of the tanning reagent and associated electrolyte. Solo complex tannage pH 4 requires no basification. After removing the leathers from the tan bath they can be treated in the normal way. For woolskins that meaans drying, degreasing and wool ironing; the natural wool colour is unaffected and the leather is pure white.

The tanning agent used in the process of the invention, and comprising complexes of aluminium (III) and titanium (IV), can be used in conjunction with other mineral tanning agents in the same bath, e.g. Zr (IV) and Cr (III). The substitution of a substantial portion of a normal chrome offer by the complex used in the process of the invention has four main benefits:

(i) Increased efficiency of chromium utilisation, with a consequent reduction in levels discharged in waste streams;

(ii) Retention of chrome character in the leather. The handle of the leather and the hydrothermal stability are controlled by the chrome offer, since it is a more potent tanning agent, at offers >0.5%$Cr_2O_3$ on pelt weight. However, at lower offers the chrome character of the leather diminishes;

(iii) Retention of leather fullness. The presence of the titanium component of the complex prevents the emptiness characteristic of pure aluminium tanned leathers; and (iv) Flatness of grain. There is a difference between emptiness and flatness in leather; for many applications the latter is desirable, but the former is undesirable. Flatness of grain is a desirable feature in most leathers and is still conferred by the aluminium component of the complex. The handle of leathers prepared from a 3-component mineral tannage can be further modified by retanning with secondary tanning agents, well known in the art. Such leathers, tanned with low chrome offers, <1%$Cr_2O_3$ on pelt weight, together with an aluminium-titanium complex, are suitable for sheepskin clothing leather (suede or grain), softee shoe upper leather, upholstery leather and any other application typically currently relying on chromium (III) tannage. Naturally, tannage with an aluminium-titanium complex alone produces white leather, but the inclusion of chromium (III) imparts blue colour to the leather. The use of an aluminium-titanium complex makes leather which is softer and fuller than those prepared from currently available aluminium tanning salts.

When chromium is included in a tannage with aluminium-titanium complex in accordance with the invention, whether offered before the complex or after the complex in the tan bath, the equilibrium pH is <4.0. The preferred final pH value is 4.0–4.2. Indeed, because the mineral uptake is so efficient, it is possible to raise that final pH to 5.0–5.5 without overtanning the surfaces. Basification can be carried out with all the conventional agents, such as sodium or ammonium bicarbonate or carbonate, magnesia or with less conventional agents such as hexamethylenetetramine.

Before applying retanning agents, dye and fatliquor to mineral tanned leather, it is normal to neutralise it to pH>4.0, the pH value depending upon the requirements of the post-tanning processes. When any leather contains aluminium (III), whether in the form of a complex with titanium (IV) as described, or as any other tanning salt, two points must be borne in mind:

(i) The pH of the leather should be <6.0 and preferably <5.5. At higher values the aluminium component of the tannage is reversed by hydrolysis, but not solubilised. Note that at pH<3.5 there is significant solubilisation of aluminium;

(ii) If anionic materials are to be used in post-tanning wet-processing, surface reaction should be prevented by reducing the cationic nature of the leather. This can be achieved by including polyphosphate in the neutralisation step.

The process of the invention is applicable to a wide range of tanning situations, both in base, prime tannage and as a part of a combination tannage if modification to the properties of the base leather is required. As a solo tannage, the leather produced has mineral tanned character, with no coloration of the substrate, and the use of toxicologically suspect aldehydes is avoided.

The invention is illustrated by the following examples.

EXAMPLE 1

20 kg of isopropyl titanate, containing 5.6 kg $TiO_2$ was hydrolysed with 100 kg of cold water. The resultant pulp, after washing and separation, was dissolved in 25.2 kg sulphuric acid, added as 96%$H_2SO_4$. After cooling to ambient temperature the resultant clear solution was diluted to 25 l with water giving a 200 g/l solution of $TiO_2$. To this was added an equivalent volume of a solution containing 400 g ammonium sulphate/l and 400 g sulphuric acid/l. The resultant precipitate of titanyl ammonium sulphate was filtered, washed with saturated ammonium sulphate solution and dried at 110° C.

588 g iron-free, hydrated aluminum sulphate (containing 17%$Al_2O_3$) was dissolved in 1.5 l water, aided by warming to 50°–60° C. 400 g sodium glucoheptonate was dissolved in 1.0 l water, aided by warming to 50°–60° C. 240 g of the dried titanyl ammonium sulphate (containing 21%$TiO_2$) previously prepared was added to the masking salt solution and stirred at the elevated temperature until completely dissolved. The masked titanium (IV) solution was added to the aluminium sulphate solution. 200 g anhydrous sodium carbonate was dissolved in 0.5 l cold water and the solution was added slowly to the masked mixed metal sulphate solution with vigorous stirring; continued heating to maintain the stirred solution at 50°–60° C. reduces the time taken to basify by aiding the solubilisation of any local precipitate. The product was aged overnight, and cooled to ambient temperature, before use. The finished reagent contained 3.33%$Al_2O_3$+1.67%$TiO_2$, masked with 1.0 molar equivalent glucoheptonate per mole $Al_2O_3$+-$TiO_2$ at pH 4.0. Samples of the finished reagent have been stored for several months with no sign of any precipitation or change in pH which might result from hydrolysis.

EXAMPLE 2

Fresh hydrated $TiO_2$ pulp, derived from a conventional sulphate process route for making titanium dioxide pigment was mixed with water to produce a slurry containing 200 g $TiO_2$ at a concentration of 330 g $TiO_2$/l. This was digested at 140° to 145° C. with 500 ml sulphuric acid containing 920 g $H_2SO_4$, giving a clear solution. Into this solution was dissolved 2.35 kg iron-free aluminium sulphate (17%$Al_2O_3$), diluting as necessary to give final solution of 40 g $TiO_2$/l and 80 g $Al_2O_3$/l.

500 ml portions of this solution were treated with sodium glucoheptonate at two levels, one containing 160 g and the other 80 g. Each masked solution was further divided into two parts, one being basified to pH 2.5 and the other to pH 4 using solid sodium carbonate. Finally each solution was diluted to 20 g $TiO_2$/l and 40 g $Al_2O_3$/l. Short-term storage trials gave no indications of instability of the solutions.

EXAMPLE 3

A 330 g $TiO_2$/l slurry, containing 200 g $TiO_2$, was prepared as in Example 2. This was digested with 1600 g $H_2SO_4$ added as the concentrated acid. To this solution was added 431 g hydrated aluminium oxide (commercial 'bauxite'-65%$Al_2O_3$) and the digestion was continued until a clear solution was obtained. Into this solution after cooling, solution was obtained. Into this solution after cooling, was dissolved a further 120 g $Al_2O_3$, added as iron-free aluminium sulphate (17%$Al_2O_3$). After dilution to 40 g $TiO_2$/l, portions of the solution were additioned with sodium glucoheptonate at levels from 0.5 to 1.0 molar equivalent on total oxides. For each level of glucoheptonate, basification using solid sodium carbonate was carred out to pH 2.5 and to pH 4. The reagents were finally diluted to 20 g $TiO_2$/l and 40 g $Al_2O_3$/l.

COMPARATIVE EXAMPLE 1

A 330 g $TiO_2$/l slurry, containing 200 g $TiO_2$ was prepared as in Example 2. This was digested with 1600 g $H_2SO_4$ added as the concentrated acid. To this solution was added 615 g hydrated aluminium oxide (commercial 'bauxite'-65%$Al_2O_3$) to give a 2:1 $Al_2O_3$:$TiO_2$ ratio. The reagents rapidly solidified in the digestion vessel indicating that there is a limit to the proportion of total $Al_2O_3$ that can be added as a bauxite to an acidified $TiO_2$ solution produced in this way.

COMPARATIVE EXAMPLE 2

A solution of titanyl sulphate was prepared from fresh hydrated $TiO_2$ pulp as described in Example 2. From this a solution containing 20 g $TiO_2$ and 10 g $Al_2O_3$ was prepared by the addition of iron-free aluminium sulphate. To the solution was added 80 g sodium glucoheptonate (1 molar equivalent on total oxides). The whole was basified to pH 2.5 using solid sodium carbonate and diluted to 1 liter. The reagent became cloudy after 1 hour and a substantial precipitate formed after 2–3 hours, indicating that the quantity of masking agent employed was inadequate in this case.

EXAMPLE 4

The reagent was prepared by the method described in Example 2 from freshly prepared hydrated $TiO_2$ pulp to the stage of masking agent addition. A 500 ml portion containing 60 g metal oxides was then masked with 80 g sodium glucoheptonate, adjusted to pH 2.5 and diluted to 1 liter. This solution was divided into four parts, one being retained as prepared and the remaining three were basified with solid sodium carbonate to pH 3.0, 3.5 and 4.0 respectively. The significant effect of reagent pH on the shrinkage temperature ($T_s$) when used in small scale tanning experiments on long wool sheepskin, is illustrated by the following table.

| pH | Shrinkage temperature $T_s$(°C.) |
|---|---|
| 2.5 | 73 |
| 3.0 | 77 |
| 3.5 | 77 |
| 4.0 | 82 |

EXAMPLE 5

The reagent was prepared by the method described in Example 2 up to the stage of adding the masking salt. 500 ml portions of this solution were treated with either 145 or 72 g of sodium gluconate. Each masked solution was basified to pH 4.0 with sodium carbonate and diluted to 40 g $Al_2O_3$/l+20 g $TiO_2$/l. Both solutions gave satisfactory small scale tannage of long wool sheepskin.

EXAMPLE 6

A wet salted Australian woolskin was processed in a normal commercial way to the pickled state. It was depickled to pH 4.0 in 5% brine with sodium carbonate. After refloating in 25 l fresh water, 100 g $Al_2O_3$+50 g $TiO_2$ was added in the form of a mixed complex prepared as described in Example 1. After running overnight 200 g fatliquor was added, the float temperature was raised to 50° C. and running continued for 4 h. The leather was drained, spun dry, toggle dried then degreased in perchloroethylene. The pure white, full leather had a shrinkage temperature of 85° C.

EXAMPLE 7

A wet salted Australian woolskin was tanned as described in Example 6 with the following exceptions. The tanning complex offer was 112.5 g $Al_2O_3$+37.5 g $TiO_2$, prepared as described in Example 1 but evaporated to dryness to give a free flowing white powder. Fatliquor was added immediately after the tanning complex and the temperature was gradually raised to 50° C. over 6 h. The shrinkage temperature of the leather was 82° C.

EXAMPLE 8

Three English shearling skins were commercially processed to the pickled state, then depickled to pH 4.6 in 30 l of 5% brine. The skins were turned for 3 h in fresh float containing 200 g $Al_2O_3$+100 g $TiO_2$ in the form of a complex prepared as described in Example 1. After adding 400 g fatliquor, the tan bath was heated to 40° C. and processing continued overnight. The shrinkage temperature of the leathers was 86° C.

EXAMPLE 9

Two Australian woolskins at pH 4 were tanned in 30 l float containing 150 g $Al_2O_3$+$TiO_2$ as a complex prepared according to Example 1. The temperature was gradually increased to 40° C. and the leathers were lubricated in the tan bath with 300 g of fatliquor. The shinkage temperature was 85° C. After dry cleaning in perchloroethylene, a skin was wash tested at 40° C. using a mild, liquid detergent. After two wash/dry cycles the shrinkage temperature was 84° C. and total area loss was 7%. In comparison, the area losses for similar skins chrome tanned or conventionally white dressed (commercially), but washed only once, were 4 and 21% respectively.

EXAMPLE 10

Six domestic shearlings were bleached by an oxidation and reduction treatment. Tannage continued in the bleach float, 25 l per skin, with 2.5 g $Al_2O_3$+$TiO_2$/l as a complex prepared according to Example 1. The shrinkage temperature was 82° C.

EXAMPLE 11

Six slink (stillborn lamb) skins were prepared by oxidation and reduction bleaching and adjustment to pH 4. They were tanned in 6 l fresh float containing 5 g $Al_2O_3$+$TiO_2$ per liter, as a complex as described in Example 1. Fatliquor, 10 g/l was applied in the tan bath. The shrinkage temperature of the leather was 75° C.

EXAMPLE 12

Bovine hide, split in the lime and processed conventionally to the pickle, which was to equilibrium at pH 4, was tanned in 100% total float containing 4% sodium chloride. Mineral offers were aluminium-titanium complex, as described in Example 1, and 33% basic chrome tanning powder; offers were based on limed weight. The pH was adjusted to a final value of 4.0 with sodium bicarbonate then the tannage was warmed from ambient temperature to 40° C. and held there for 1 h. After ageing for 24 h the following shrinkage temperatures were obtained.

| Rawstock | Chrome Offer (% $Cr_2O_3$) | Complex offer (% $Al_2O_3$ + $TiO_2$) | Sequence of offers | $T_s$ (°C.) |
|---|---|---|---|---|
| Flesh split | 0 | 2.0 | — | 85 |
| | 0.5 | 1.5 | Chrome first | 96 |
| | 0.5 | 1.5 | Chrome second | 95 |
| | 1.0 | 1.0 | Chrome first | 103 |
| | 1.0 | 1.0 | Chrome second | 101 |
| Grain split | 0 | 2.0 | — | 89 |
| | 1.0 | 1.0 | Chrome first | 98 |
| | 1.0 | 1.0 | Chrome first | 101 |
| | 2.0 (reference) | 0 | — | 103 |

EXAMPLE 13

Fellmongered, pickled sheepskin was solvent degreased and depickled to pH 4. Tannage with 0.75%$Cr_2O_3$ and 1.25%$Al_2O_3+TiO_2$, as a complex as described in Example 1 (offers on depickled pelt weight and either sequence of addition) resulted in 99.5–99.7% of the chrome offer being taken up by the skin, to give shrinkage temperatures of 100°–102° C.

EXAMPLE 14

Tannage of sheepskin as described in Example 13, but using 0.5%$Cr_2O_3$ and 1.5%$Al_2O_3+TiO_2$, gave shrinkage temperatures of 93°–94° C. and 99.5–99.8% chrome uptake.

After neutralisation with 1% sodium hexametaphosphate and sodium bicarbonate to pH 6, the leathers were retanned with 6% sulphite mimosa and fatliquored before crusting. The shrinkage temperatures were 110°–114° C. Retannage with 3% sulphited mimosa+3% sulphone syntan gave shrinkage temperatures of 96°–100° C.

EXAMPLE 15

One whip snake skin (70 g) received pickled was depickled to pH 4.5 with sodium bicarbonate. It was agitated overnight at ambient temperature in 500% fresh float containing 30 g fatliquor/l and 20 g $Al_2O_3$/l+10 g $TiO_2$/l in the form of a complex prepared as described in Example 1.After rinsing, toggle drying and staking, the shrinkage temperature was 79° C. The natural markings and contrast were unaffected by the process.

What I claim is:

1. A leather tanning process in which animal skins are treated with a tanning agent comprising a mixed complex of aluminum (III) ions and titanium (IV) ions and as a masking compound a salt of a polyhydroxymonocarboxylic acid.

2. A process according to claim 1, wherein the masking compound has the general formula:

$$HOCH_2(CHOH)_nCO_2M$$

wherein M is an alkali metal, and n is 2 to 6.

3. A process according to claim 2, wherein the masking compound is sodium gluconate or sodium glucoheptonate.

4. A process according to claim 1, wherein the tanning agent comprises aluminium (III) ions and titanium (IV) ions in a molar ratio of 1.5 to 2.35:1 calculated as $Al_2O_3$:$TiO_2$.

5. A process according to claim 4, wherein said molar ratio is 1.5 to 2.0:1.

6. A process according to claim 1, wherein the tanning is carried out at a pH of 3 to 5.

7. A process according to claim 1, wherein the tanning agent is prepared by dissolving hydrated titanium dioxide in sulphuric acid, adding aluminium sulphate to the solution, adding the masking compound, and adding a base to adjust the pH of the resulting solution.

8. A process according to claim 1, wherein the tanning agent also contains Zr (VI) and/or Cr (III) ions.

9. A process according to claim 4, wherein the masking compound is sodium glucoheptonate, in an amount of from 0.5 to 1.5 molar equivalent glucoheptonate per mole $Al_2O_3+TiO_2$.

10. A process according to claim 1, wherein the tanning agent is in aqueous solution in a concentration such as to give less than 10 g of aluminium and titanium, calculated as the metal oxides per liter of solution.

11. A process for tanning an animal skin comprising contacting the animal skin with a tanning agent, the tanning agent comprising a mixed complex of aluminum (III) ions, titanium (IV) ions and compound having the general formula $$HOCH_2(CHOH)_nCO_2M$$

wherein M is an alkali metal, n is 2 to 6, the tanning agent having a pH in the range of from about 3 to about 5.

12. A process as recited in claim 11 wherein the aluminium (III) ions and titanium (IV) ions have a molar ratio in the range of about 1.5:1 to about 2.35:1 calculated as $Al_2O_3$:$TiO_2$.

13. A tanning agent for animal skins comprising:

a mixed complex of aluminum (III) ions, titanium (IV) ions and a compound having the general formula $$HOCH_2(CHOH)_nCO_2M$$

wherein M is an alkali metal, n is 2 to 6, the tanning agent having a pH in the range of from about 3 to about 5 in an aqueous media.

14. A tanning agent as recited in claim 13 wherein the aluminum (III) ions and titanium (IV) ions have a molar ratio in the range of about 1.5:1 to about 2.35:1 calculated as $Al_2O_3$:$TiO_2$.

* * * * *

UNITED STATES PATENT AND TRADEMARK OFFICE

CERTIFICATE OF CORRECTION

PATENT NO. : 4,731,089

DATED : March 15, 1988

INVENTOR(S) : Anthony D. Covington

It is certified that error appears in the above-identified patent and that said Letters Patent is hereby corrected as shown below:

Column 1, line 64, after "soft" insert --and--.

Column 6, line 42,43, delete "Into this solution after cooling, solution was obtained."

Signed and Sealed this

Sixth Day of September, 1988

*Attest:*

DONALD J. QUIGG

*Attesting Officer*

*Commissioner of Patents and Trademarks*